US005379887A

United States Patent [19]

Conley, Jr.

[11] Patent Number: 5,379,887

[45] Date of Patent: Jan. 10, 1995

[54] METHOD AND APPARATUS FOR MANAGING SEWING MACHINE SPARE PARTS

[75] Inventor: Ralph F. Conley, Jr., Miamisburg, Ohio

[73] Assignee: MIM Industries, Inc., Miamisburg, Ohio

[21] Appl. No.: 163,445

[22] Filed: Dec. 7, 1993

[51] Int. Cl.[6] ..... B65D 69/00; B65D 71/00

[52] U.S. Cl. ..... 206/232; 206/223/459.5; 220/523

[58] Field of Search ..... 206/459.5, 216, 223, 206/232; 220/523

[56] References Cited

U.S. PATENT DOCUMENTS

| | | | |
|---|---|---|---|
| 3,627,122 | 12/1971 | Garbe, Jr. | 206/459.5 X |
| 3,679,047 | 7/1972 | Papirnyik | 206/459.5 X |
| 3,987,897 | 10/1976 | Smith | 206/459.5 X |
| 4,090,606 | 5/1978 | Dawson | 206/459.5 X |
| 4,123,125 | 10/1978 | Andry, III | 206/459.5 X |
| 4,195,059 | 3/1980 | Whitcher et al. | 206/459.5 X |
| 4,828,113 | 5/1989 | Friedland et al. | 206/459.5 X |
| 5,046,609 | 9/1991 | Mangini et al. | 206/459.5 X |
| 5,178,295 | 1/1993 | Crumrine et al. | 220/523 |

OTHER PUBLICATIONS

Brother Industries Ltd., "Electronic Programmable Pattern Tacker BAS-310 Parts Book", published Dec., 1987, covers and p. 18.

*Primary Examiner*—William I. Price

*Attorney, Agent, or Firm*—Biebel & French

[57] ABSTRACT

A method and system comprising a sewing machine spare parts kit having a base comprising a plurality of compartments and a lid which, in one embodiment of the invention, is hingeably secured to the base. The kit also comprises a plurality of order record forms. The order record form has a plurality of record areas with indicia of part number, part name, and order quantity. The plurality of record areas are arranged in the same order that the spare parts are arranged in the kit. The order record members and kit facilitate identifying the spare parts which are housed in the kit as well as the quantity of spare parts to be maintained in each compartment of the kit. The order record form may be provided in the form of a postcard or alternatively, it may be provided in full scale such that it replicates in full scale the compartments in the kit, thereby making it easy for a service technician to reference, identify, order and use the spare parts in the kit.

32 Claims, 3 Drawing Sheets

METHOD AND APPARATUS FOR MANAGING SEWING MACHINE SPARE PARTS

BACKGROUND OF THE INVENTION

1. Field of the Invention

This invention relates to spare parts for sewing machines and, more particularly, to a method and apparatus for managing sewing machine spare parts in order to facilitate maintaining and servicing the sewing machines.

2. Description of Related Art

In the sewing industry, it is common for technicians to support and maintain sewing machines. The technicians often use a variety of spare parts to service the sewing machine and to keep it in proper working order.

A problem with maintaining and supporting sewing machines of the past was that there was no easy way to keep track of all the spare parts necessary to maintain one or more sewing machines. In addition, because some parts on the sewing machine wore out more frequently than others, it was often difficult to determine what quantity of spare parts to keep on hand. Finally, it was also either difficult or cumbersome to identify the spare parts in a manner that would permit them to be easily identified and subsequently replenished.

Accordingly, what is needed is an easy and effective spare parts management system that enables a technician to easily identify and subsequently order spare parts so that a predetermined quantity of spare parts are maintained at all times, thereby enabling the technician to effectively and timely maintain and service the sewing machines.

SUMMARY OF THE INVENTION

Accordingly, a primary object of this invention is to provide a method and management system which will permit a technician to easily identify and maintain a particular quantity of spare parts in a spare parts kit so that the technician can service the sewing machines in a time and cost effective manner.

In one aspect a sewing machine spare parts kit comprises a base having a plurality of compartments; each of the plurality of compartments being suitable for receiving at least one sewing machine spare part, the at least one sewing machine spare part being arranged in the plurality of compartments in a predetermined order; a lid associated with the base; a plurality of record members having a plurality of record areas which are arranged thereon to generally correspond to the predetermined order; and an order indicator associated with each of the plurality of record areas for facilitating the identification of the at least one sewing machine spare part when the at least one sewing machine spare part needs to be replaced.

A method for managing spare parts comprises the steps of providing a parts kit having a plurality of storage compartments therein, the storage compartments being arranged in a predetermined order, each of the storage compartments being suitable for storing at least one part; providing an order record form having a plurality of record areas which are generally arranged in the predetermined order to correspond to the arrangement of the storage compartments; marking the order record form with an indicia to readily identify the at least one part for use at a later time.

In yet another aspect of the invention a system for maintaining a predetermined quantity of spare parts, said system comprises a kit for storing the predetermined quantity of spare parts in a predetermined order; and at least one order record member associated with the kit, the at least one order record member comprising a plurality of record areas which are arranged to generally correspond to said predetermined order; the at least one order record member facilitating identification of parts to be ordered so as to maintain the quantity of spare parts at said predetermined quantity.

In still another aspect of the invention this invention comprises a part management system comprising a holder having a plurality of storage areas which are each capable of holding at least one predetermined part in a predetermined order; a plurality of record members associated with the holder, each of the plurality of record members having a plurality of record areas which are arranged thereon to generally correspond to the predetermined order; and an order indicator associated with each of the plurality of record areas for identifying at least one predetermined part when the predetermined part needs to be replenished.

An object of this invention is to provide a spare parts kit which provides a record member which facilitates identifying spare parts.

Another object of this invention is to provide a spare parts kit comprising an order record form which enables a technician to easily identify a particular quantity of spare parts to be ordered.

Still another object of the invention is to provide a portable sphere parts kit which enables a technician to reduce the amount of time identifying and replenishing or ordering spare parts, thereby reducing the amount of time needed to service one or more sewing machines.

Still another object of the invention is to provide a method and apparatus which is simple in design and easy to use.

These advantages and others will become more apparent in connection with the following description, claims and drawing.

DETAILED DESCRIPTION OF INVENTION

Figure 1:
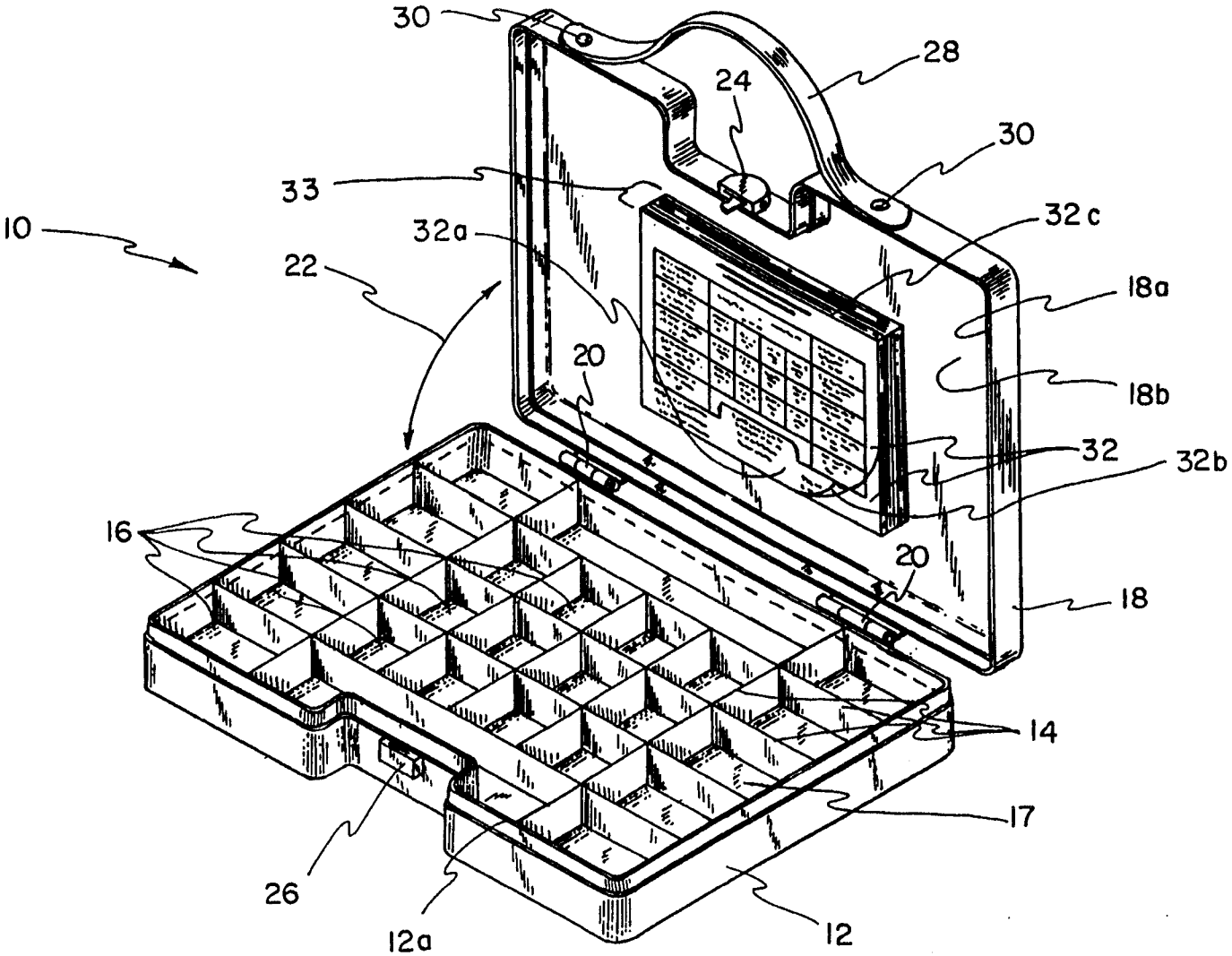
FIG. 1 is a perspective view of the sewing machine spare parts kit according to one embodiment of the invention.

Referring now to FIG. 1, a sewing machine spare parts kit or parts kit 10 according to one embodiment of the invention is shown. The parts kit 10 comprises a base portion 12 having a plurality of walls 14 which define a plurality of compartments 16. Each of the plurality of compartments 16 are suitable for receiving at least one sewing machine spare part (not shown). For example, the at least one sewing machine spare part kit may include a hooked driving gear, hook saddle, opener bracket, hook screw, trimming knife holder, bobbin, bobbin cassette, O.L. wick, gear complete, bolt, fixed blade, trimming knife holder, needle bar, movable knife, needle bar thread, thread take-up leavet, thread take-up support, knife pad (right), knife pad (left), guide, and a variety of screws used for maintaining and supporting a sewing machine (not shown) and the use thereof.

In the embodiment being described, the at least one sewing machine spare part is arranged in the plurality of compartments 16 in a predetermined order. As shown in parenthesis in FIG. 1, each of the spare parts may be assigned to a particular compartment 16. For example, a knife pad (not shown) may be assigned to a compartment 17. The other compartments may likewise have an assigned spare part. It should be noted that the plurality of compartments may be arranged and shaped in a predetermined manner to facilitate organizing and storing the sewing machine spare parts.

As illustrated in FIG. 1, the spare parts kit 10 also comprises a lid 18. In the embodiment being described, the lid is hingeably secured to the base portion via hinges 20. The base 12, lid 18 and hinges 20 are integrally molded in a one-piece construction from plastic. It should be appreciated, however, that the lid 18 could be provided in a two-piece construction to enable the lid 18 to be removable from the base 12. The hinges 20 facilitate permitting the lid 18 and base 12 to hinge or move in the direction of double arrow 22. This permits the lid 18 to be moved from an open position (as shown in FIG. 1) to a closed position (not shown).

In the embodiment being described, the base 12 has a male flange **12*a* which mates with a female flange 18*a* on lid 18. The male and female flanges 12*a* and 18*a* facilitate aligning and positioning the lid 18 on base 12**.

The spare parts kit also comprises a lock having a male lock member 24 which cooperatively mates with a female lock member 26 to lock the lid 18 to base 12 when the lid 18 is in the closed position. Notice also that the lid 18 comprises a handle 28 which is secured to the lid 18 with a plurality of screws or rivets 30. The handle 28 facilitates opening the spare parts kit 10 and also transporting the spare parts kit 10. The lid 18 may also comprise foam 19 adhesively secured on its underside **18*b* to facilitate sealing the compartments 16 when the lid is in the closed position. The spare parts kit 10 further comprises a plurality of record members 32 having a front side 32*a* and a back side 32*b*. In the embodiment being described, the plurality of record members 32 are provided in a "pack" and have a top end 32*c* which is adhesively secured to an underside 18*b* of lid 18. When each of the plurality of record members 32 has been used in the manner described below, a new "pack" of plurality of record members may be adhesively secured to underside 18*b***.

Figure 2:
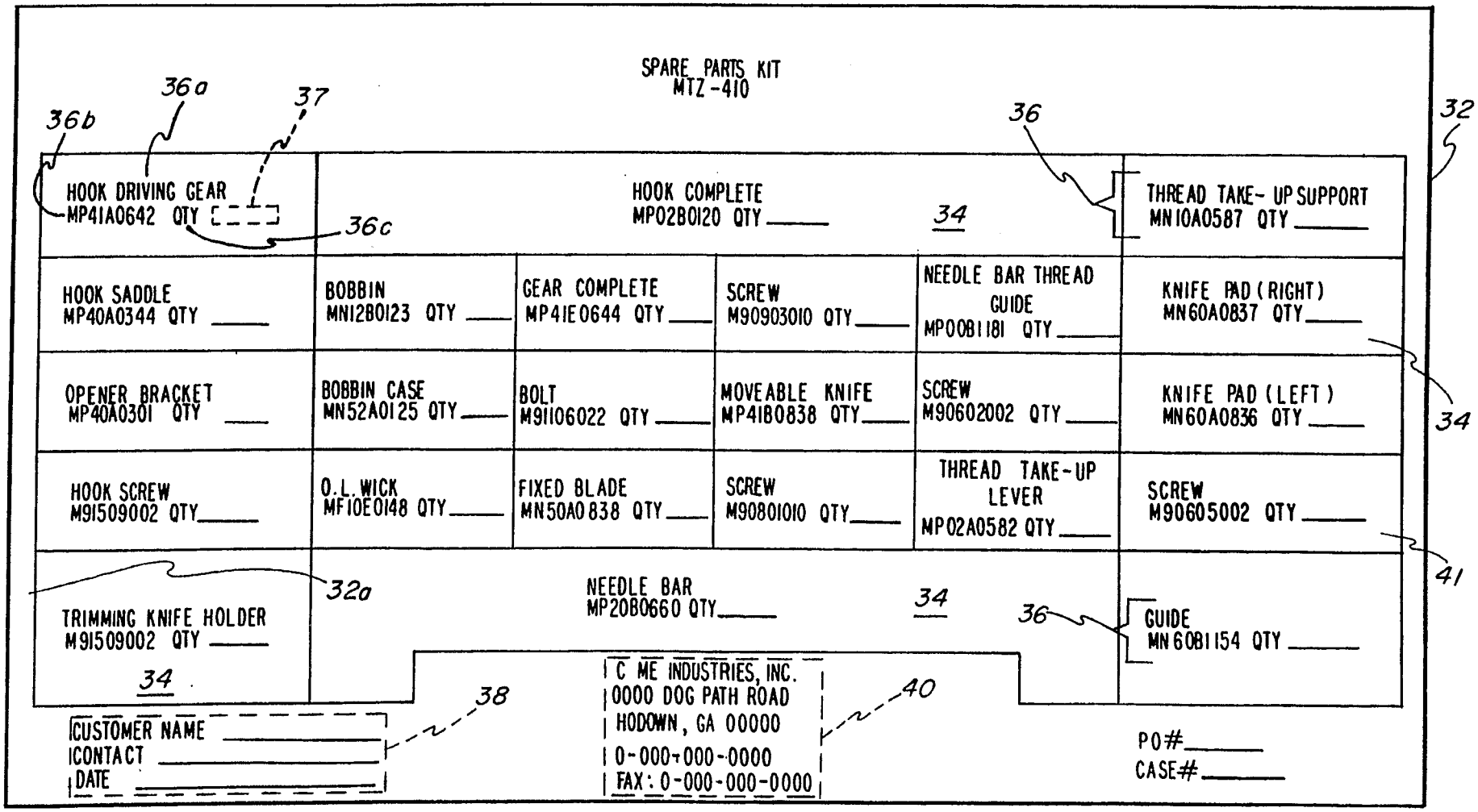
FIG. 2 is a plan view of one of the plurality of order record members shown in FIG. 1.

As best illustrated in FIG. 2, each of the plurality of record members 32 comprises a plurality of record areas 34 which are laid out or arranged to generally correspond to the predetermined order of the at least one sewing machine part (not shown). As mentioned earlier herein, each sewing machine spare part is assigned to a particular one of the plurality of compartments 16. Once assigned, the plurality of record areas 34 are arranged on the order record form 32 to correspond to the arrangement of the order of sewing machine spare parts. It is to be noticed that each of the plurality of record areas 34 comprises an order indicator 36. The order indicator 36 facilitates identifying a sewing machine spare part. In this regard, the order indicator 36 may comprise a part name **36*a*, part number 36*b* and quantity indicia 36*c*** in order to facilitate the identification of a spare part.

In the embodiment being described, each of the plurality of record members 32 may comprise orderer identification information 38 for identifying an entity which may order sewing machine spare parts. In addition, each of the plurality of record members 32 may also comprise spare parts supplier or sender identification information 40 for identifying an entity which may use the order record member 32 to supply spare parts to the orderer. It should be appreciated that although the plurality of record members 32 could be provided in the pack 33 (FIG. 1) which is adhesively secured to the underside **18*b* of lid 18 in one embodiment, the pack 33 could be provided separately. In addition, the order record form 32 could be provided in full scale relative to the plurality of compartments 16 to further facilitate identification of spare parts. For example, the order record form 32** may be provided on an 8 ½" by 11" sheet to further facilitate identifying the spare parts and quantities of spare parts needed to bring the quantity of spare parts to a desired or predetermined quantity. In this regard, the technician would reproduce the form, indicate the quantity of replacement spare parts needed and communicate the information to the supplier, for example, by ordinary mail or facsimile transmission.

It should also be noted that each of the order record members 32 could be in the form of a postcard having the plurality of record areas 34 on one side and the sender identification information 40 on another side with appropriate postcard postage. This would also facilitate an orderer's identification and subsequent ordering of a spare part. As shown in FIG. 2, the quantity indicia **36*c* is provided with a blank space 37 to permit an orderer to fill in an appropriate quantity of that particular spare part, as it may be desired to have more than one of a particular spare part stored in its designated compartment 16. For example, the storage compartment 17 in FIG. 1** may be designated to store a left knife pad part No. MN60AO836. As the quantity of these knife pads goes below the predetermined quantity, an orderer may identify the number of knife pads desired or needed to bring the quantity of knife pads up to the predetermined quantity.

Advantageously, the management system of the present invention permits its user to easily identify spare parts which have been used and which need to be replenished. The system provides an easy and effective means for identifying the spare parts to be replenished by using the record order form and subsequently using the record order form to restore the quantity of spare parts in any given compartment 16 to the desired or predetermined quantity. In this regard, the order record form 32 could be in the form of a postcard. Alternatively, as illustrated in FIG. 2, the order record form 32 could comprise a telephone number or facsimile number for facilitating ordering an appropriate quantity of spare parts. The spare parts kit 10 and management system of the present invention enables a service technician or operator to easily maintain an appropriate quantity of spare parts, thereby facilitating the maintenance of the sewing machine. A method for managing spare parts using the management system and spare parts kit 10 of the present invention will now be described in relation to FIG. 3.

Figure 3:
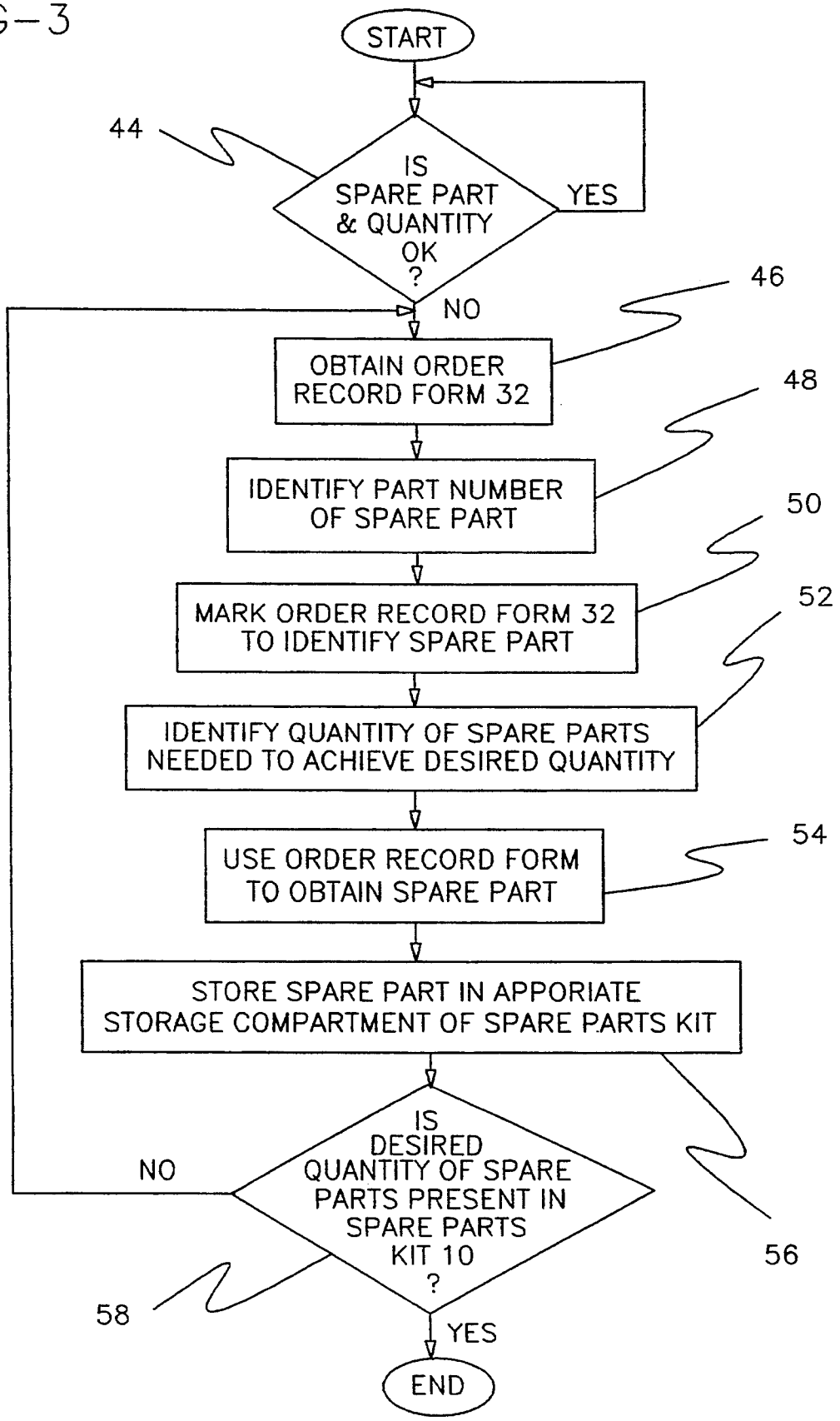
FIG. 3 is a schematic diagram of a method and system for managing spare parts in accordance with this invention.

As illustrated in decision block 44, in FIG. 3, a determination is made as to whether the quantity of spare parts in each of the plurality of compartments 16 is at an acceptable quantity level. If the quantity level is acceptable, one is returned to the beginning. If not, then an order record form 32 is obtained and referenced at block 46. Subsequently, the part number of the spare part is identified at block 48. At block 50, the technician may then mark the quantity indicia **36*c* at space 37**

(FIG. 2) and identify the spare part for use at a later time, for example, when obtaining a replacement spare part. At block 52 (FIG. 3), the technician may identify in space 37 (FIG. 2) the quantity of spare parts needed. Subsequently, the order record form 32 may be used to obtain the needed spare part. In this regard, the order record form 32 may be provided as a postcard so that the technician can simply drop the order record form 32 in the mail. Alternatively, the order record form may be provided with the sender or supplier information 40 (FIG. 2) which may include the telephone or facsimile numbers such that the technician can obtain a replacement spare part via the telephone. Upon receipt of the spare part, it is stored in its appropriate storage compartment 16 (block 56) of the spare parts kit 10. At decision block 58, a determination is made as to whether the desired or predetermined quantity of spare parts are present in each compartment 16. If not, the abovementioned process is repeated until the spare parts kit 10 comprises the desired quantity of each of the spare parts stored in the spare parts kit 10. If the desired quantity of spare parts is present in the spare parts kit 10, then the process is complete and the spare parts kit 10 and management system can subsequently be used to maintain the sewing machine.

Although the method and apparatus of this invention has been described in relation to a sewing machine spare parts kit, it should be appreciated that this method and apparatus could be used to provide a management system for any type of parts or items which are used and replenished on a regular or even a periodic basis. Thus, while the invention has been described with reference to a specific embodiment, this description is merely illustrative, and it is not to be construed as limiting the scope of the invention. Various other modifications and changes may occur to those skilled in the art without departing from the true spirit and scope of the invention as defined by the appended claims.

I claim:

1. A sewing machine spare parts kit comprising:

a base having a plurality of compartments; each of said plurality of compartments being suitable for receiving at least one sewing machine spare part, said at least one sewing machine spare part being arranged in said plurality of compartments in a predetermined order;

a lid associated with said base;

a plurality of record members each having a plurality of record areas which are arranged thereon to generally correspond to said predetermined order; and an order indicator associated with each of said plurality of record areas for facilitating the identification of said at least one sewing machine spare part when said at least one sewing machine spare part needs to be replaced.

2. The sewing machine spare parts kit of claim 1 wherein each of said plurality of record members comprises a post card having said plurality of record areas on one side and supplier identification information on an opposite side.

3. The sewing machine spare parts kit of claim 1 wherein said order indicator comprises a part number and quantity indicia.

4. The sewing machine spare parts kit of claim 1 wherein each of said plurality of record members comprise orderer identification information.

5. The sewing machine spare parts kit of claim 1 wherein each of said plurality of record members comprise sender identification information.

6. A method for managing spare parts comprising the steps of:

arranging the spare parts in a spare parts kit having a plurality of storage compartments therein, said storage compartments being arranged in a predetermined order, each of said storage compartments being suitable for storing at least one of said spare parts;

providing an order record form having a plurality of record areas which are generally arranged in said predetermined order to correspond to the arrangement of said storage compartments; and marking said order record form with an indicia in a record area corresponding to a storage compartment storing a selected one of said spare parts to readily identify said selected one of said spare parts for use at a later time.

7. The method as recited in claim 6 wherein said using step further comprises the step of:

indicating on said order record form the at least one part which is to be ordered.

8. The method as recited in claim 7 wherein said order record form comprises at least a part number for each of said at least one part in each of said plurality of record areas.

9. The method as recited in claim 6 wherein said providing step further comprises the step of:

providing a plurality of order record forms.

10. The method as recited in claim 6 wherein said order record form comprises orderer identification information and sender identification information, said method further comprising the step of:

using said orderer and sender identification information to order at least one part.

11. The method as recited in claim 6 wherein said using step further comprises the steps of:

using said at least one part stored in said storage kit;

ordering a replacement part using said order record form.

12. The method as recited in claim 11 wherein said method further comprises the step of:

storing a replacement part in said storage compartment for the at least one part which was used.

13. A system for maintaining a predetermined quantity of spare part:s, said system comprising:

a kit for storing said predetermined quantity of spare parts in a predetermined order; and at least one order record member associated with said kit, said at least one order record member comprising a plurality of record areas which are arranged to generally correspond to said predetermined order;

said at least one order record member facilitating identification of parts to be ordered so as to maintain the quantity of spare parts at said predetermined quantity.

14. The system as recited in claim 13 wherein said kit further comprises a plurality of compartments for storing said predetermined quantity of parts.

15. The system as recited in claim 13 wherein said system comprises a plurality of said at least one order record members detachably secured to said kit.

16. The system as recited in claim 13 wherein said kit comprises a base having a plurality of compartments for storing said predetermined quantity of parts and a lid for securing to said base to enclose said plurality of compartments.

17. The system as recited in claim 13 wherein said at least one order record member comprises an order indicator comprising a part number associated with at least one of said predetermined quantity of spare parts.

18. The system as recited in claim 17 wherein said order indicator comprises orderer identification information.

19. The system of claim 17 wherein said order indicator comprises supplier identification information.

20. A part management system comprising:

a holder having a plurality of storage areas which are each capable of holding at least one predetermined part in a predetermined order;

a plurality of record members associated with said holder, each of said plurality of record members having a plurality of record areas which are arranged thereon to generally correspond to said predetermined order; and an order indicator associated with each of said plurality of record areas for identifying at least one predetermined part when said predetermined part needs to be replenished.

21. The part management system of claim 20 wherein said holder comprises a base having said plurality of storage areas and a lid for securing to said base in order to enclose said plurality of storage areas.

22. The part management system of claim 20 wherein each of said plurality of record members comprises a post card having said plurality of record areas on one side and supplier identification information on an opposite side thereof.

23. The part management system of claim 20 wherein said order indicator comprises a part number and quantity indicia for facilitating ordering said at least one predetermined part.

24. The part management system of claim 22 wherein said order indicator comprises orderer identification information.

25. The part management system of claim 20 wherein said order indicator comprises supplier identification information.

26. A system for maintaining a predetermined quantity of spare parts, said system comprising:

a kit including a portion for storing said predetermined quantity of spare parts in a predetermined order; and at least one order record member secured to said kit, said at least one order record member comprising a plurality of record areas which are arranged to generally correspond to said predetermined order;

said at least one order record member facilitating identification of parts to be ordered and being removable from said kit for use to maintain the quantity of spare parts at said predetermined quantity.

27. The system as recited in claim 26 wherein said kit further comprises a plurality of compartments for storing said predetermined quantity of parts.

28. The system as recited in claim 26 wherein said kit comprises a base having a plurality of compartments for storing said predetermined quantity of parts and a lid for securing to said base to enclose said plurality of parts.

29. The system as recited in claim 26 wherein each of said plurality of record members comprises an order indicator comprising a part number associated with said at least one predetermined part.

30. The system as recited in claim 26 wherein said at least one order record from comprises orderer identification information.

31. The system as recited in claim 26 wherein said at least one order record form comprises supplier identification information.

32. A system for maintaining a predetermined quantity of spare parts, said system comprising:

a kit for storing said predetermined quantity of spare parts in compartments in a predetermined two-dimensional arrangement; and at least one order record member secured to said kit and spaced from said compartments, said at least one order record member comprising a plurality of record areas which are arranged in a two-dimensional arrangement generally corresponding to said predetermined two-dimensional arrangement of said compartments;

said at least one order record member inducing indicia within each record area for identifying parts of said predetermined quantity of spare parts, said at least one order record member being removable from said kit for use to maintain the quantity of spare parts at said predetermined quantity of spare parts.

* * * * *

UNITED STATES PATENT AND TRADEMARK OFFICE

CERTIFICATE OF CORRECTION

PATENT NO. : 5,379,887

DATED : Jan. 10, 1995

INVENTOR(S) : Ralph F. Conley, Jr.

It is certified that error appears in the above-indentified patent and that said Letters Patent is hereby corrected as shown below:

Claim 32, Col. 8, line 42, "inducing" should be -- including --.

Signed and Sealed this

Seventh Day of March, 1995

*Attest:*

Bruce Lehman

BRUCE LEHMAN

*Attesting Officer*

*Commissioner of Patents and Trademarks*